US005098013A

United States Patent [19]

France et al.

[11] Patent Number: 5,098,013

[45] Date of Patent: Mar. 24, 1992

[54] SINGLE SLICE PIZZA CARRIER

[75] Inventors: Stephen L. France, Convis Township, Calhoun County; Gregory P. Phelps, Portage, both of Mich.

[73] Assignee: Arvco Container Corporation, Kalamazoo, Mich.

[21] Appl. No.: 641,199

[22] Filed: Jan. 15, 1991

[51] Int. Cl.[5] ..... B65D 5/30

[52] U.S. Cl. ..... 229/115; 206/551; 229/120.21; 229/195; 229/906

[58] Field of Search ..... 206/551; 229/115, 120.12, 229/195, 902, 906, DIG. 13

[56] References Cited

U.S. PATENT DOCUMENTS

| | | | |
|---|---|---|---|
| Re. 29,185 | 4/1977 | Tolaas | 229/115 |
| 798,264 | 8/1905 | Carrier | 229/107 |
| 1,158,046 | 10/1915 | Haines | 229/115 |
| 1,353,689 | 9/1920 | Wilkie | 229/115 |
| 1,716,975 | 6/1929 | Phillips | 229/115 |
| 2,011,383 | 8/1935 | Taylor | 229/DIG. 13 |
| 2,220,110 | 11/1940 | Layton | 229/115 |
| 2,298,146 | 10/1942 | Mersbach | 229/115 |
| 2,452,969 | 11/1948 | Victor . | |
| 3,335,846 | 8/1967 | Mills | 206/551 |
| 3,771,713 | 11/1973 | Davidson | 229/906 |
| 4,298,157 | 11/1981 | De Vierno | 229/195 |
| 4,492,333 | 1/1985 | Roberts | 206/551 |
| 4,798,323 | 1/1989 | Platt | 229/115 |
| 4,811,846 | 3/1989 | Bottega | 206/551 |
| 4,836,593 | 6/1989 | Cooley | 206/551 |

FOREIGN PATENT DOCUMENTS

| | | | |
|---|---|---|---|
| 69977 | 9/1949 | Denmark | 229/115 |
| 1457578 | 9/1966 | France | 206/551 |

*Primary Examiner*—Gary E. Elkins

*Attorney, Agent, or Firm*—Flynn, Thiel, Boutell & Tanis

[57] ABSTRACT

A tray for transporting a single slice of pizza while facilitating use of the tray as a support so that the piece of pizza can be removed from and repositioned on the tray during eating thereof. The tray includes a generally triangular bottom wall and a pair of low-height side walls which extend along opposite identical side edges of the bottom wall. The other or base edge of the tray is open to facilitate movement of a piece of pizza either onto or off of the tray. The tray is formed from a flat blank constructed preferably of corrugated paperboard, with fold lines separating the low side walls from the bottom wall so that the side walls can be folded upwardly to be generally perpendicular to the bottom wall. One of the side walls has a latching tab integrally associated therewith and foldable so as to wrap around one end of the other side wall for insertion into an elongate slot which extends along the fold between the other side wall and the bottom wall to latch the tray in its assembled position.

6 Claims, 3 Drawing Sheets

SINGLE SLICE PIZZA CARRIER

FIELD OF THE INVENTION

This invention relates to an improved carrier or tray formed from a foldable blank and designed specifically for transport of a food product such as a single slice of pizza.

BACKGROUND OF THE INVENTION

Many foldable blanks are known which are used to create a box or other suitable support for transporting food products such as pizza. Most of these known arrangements, however, are not suitable for transporting a single slice of pizza, such as when hot pizza is sold by the slice in shopping malls and the like. More specifically, the known arrangements either have not possessed a structure suitable to permit convenient handling of a single slice of pizza and eating thereof if desired, and/or have possessed a structure which is more complex and hence more expensive then desired, or have been unable to provide the necessary stiffness and support required when transporting an object such as a slice of hot pizza.

Examples of prior structures are shown in the following U.S. Pat. Nos. 4,836,593, 4,811,846, 4,798,323, 4,492,333, 2,452,969, 1,353,689, 1,158,046 and 798,264.

Accordingly, it is an object of this invention to provide an improved carrier or tray for supporting a food product such as a slice of hot pizza, which carrier or tray can stably and safely support such product and can be economically and efficiently constructed and assembled, and hence overcome many of the disadvantages associated with known arrangements.

In a preferred embodiment of the present invention, there is provided a tray designed specifically for transporting a single slice of pizza while facilitating use of the tray as a support so that the piece of pizza can be removed from and repositioned on the tray during eating thereof. The tray includes a generally triangular bottom wall and a pair of low-height side walls which extend along opposite identical side edges of the bottom wall. The side walls directly latch together. The other or base edge of the tray is open to facilitate movement of a piece of pizza either onto or off of the tray. The tray is formed from a flat blank constructed preferably of corrugated paperboard, with fold lines separating the low side walls from the bottom wall so that the side walls can be folded upwardly to be generally perpendicular to the bottom wall. One of the side walls has a latching tab integrally associated therewith and foldable relative thereto so as to wrap around one end of the other side wall for insertion into an elongate slot which extends along the fold between the other side wall and the bottom wall to latch the tray in its assembled position.

According to the present invention, the blank defining the tray described above is preferably created by suitable scoring a larger circular blank so that a plurality of identical generally triangular blanks can be created from each circular blank so as to facilitate and economize initial manufacture and shipping of the circular blank, while at the same time permitting easy separation of the individual triangular blanks and assembly thereof into the desired trays.

According to a preferred variation of the present invention, the carrier has a flange or base wall joined along the base edge of the bottom wall through a suitable fold, and this base wall is joined through a further generally parallel fold to a generally triangular top wall. This top wall has side flanges joined along opposite side edges thereof through suitable fold lines. This variation of the tray is initially formed as a flat blank, preferably of corrugated paperboard, and can be folded to define a generally closed carrier suitable for carrying a single slice of hot pizza. The carrier is folded about the opposite edges of the base wall so that the top and bottom walls generally overlap one another. The side flanges on the top wall are adapted to nest downwardly over the side walls associated with the bottom wall, and the nesting side flanges are provided with vertical notches or cuts which result in adjacent portions of each of the side flanges being slightly sidewardly deflected so that the cuts effectively interfit and create a nesting and locking engagement between the nested side flanges and walls associated respectively with the top and bottom walls. The side walls also have a latching tab integrally provided on one thereof and engageable with a slot which is formed along the fold between the other side wall and the bottom wall.

Other objects and purposes of the invention will be apparent to persons familiar with structures of this general type upon reading the following specification and inspecting the accompanying drawings.

Figure 1:
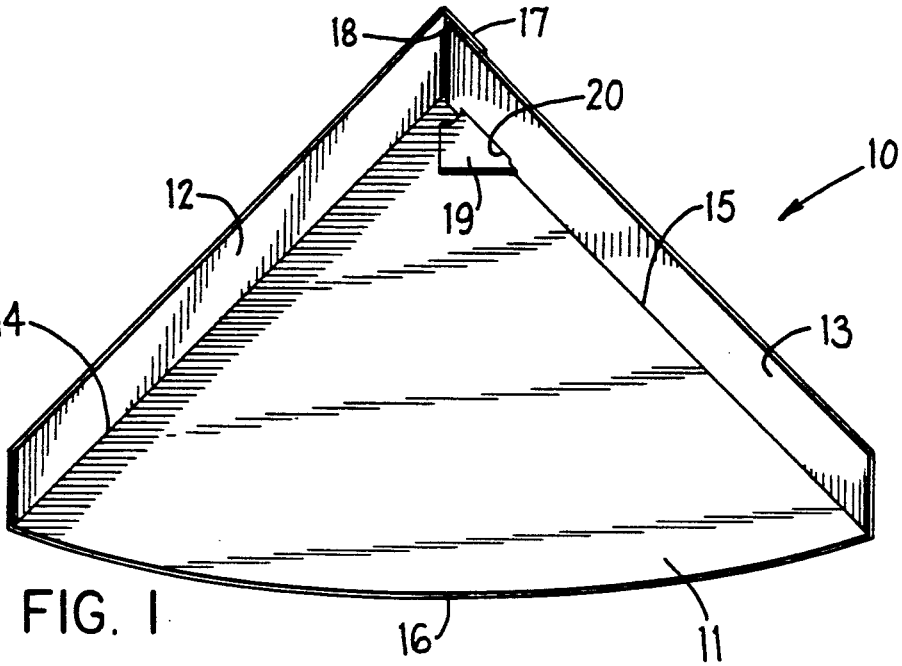
FIG. 1 is a perspective view of an open tray according to the first embodiment of the present invention.
Figure 3:
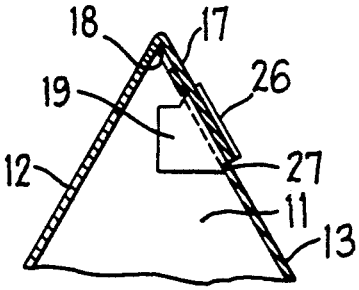
FIG. 3 is a fragmentary sectional view of the tray as shown in FIG. 1.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the tray or blank and designated parts thereof. Said terminology will include the words specifically mentioned, derivatives thereof, and words of similar import.

DETAILED DESCRIPTION

Before considering the preferred embodiments of the present invention, it should be noted that the inventive tray is normally constructed from paper sheets, preferably corrugated paperboard having a corrugated interior layer bonded between a pair of flat facing layers, which layers are all of rather thin paper. Such material is conventionally referred to as corrugated paperboard or cardboard.

Figure 2:
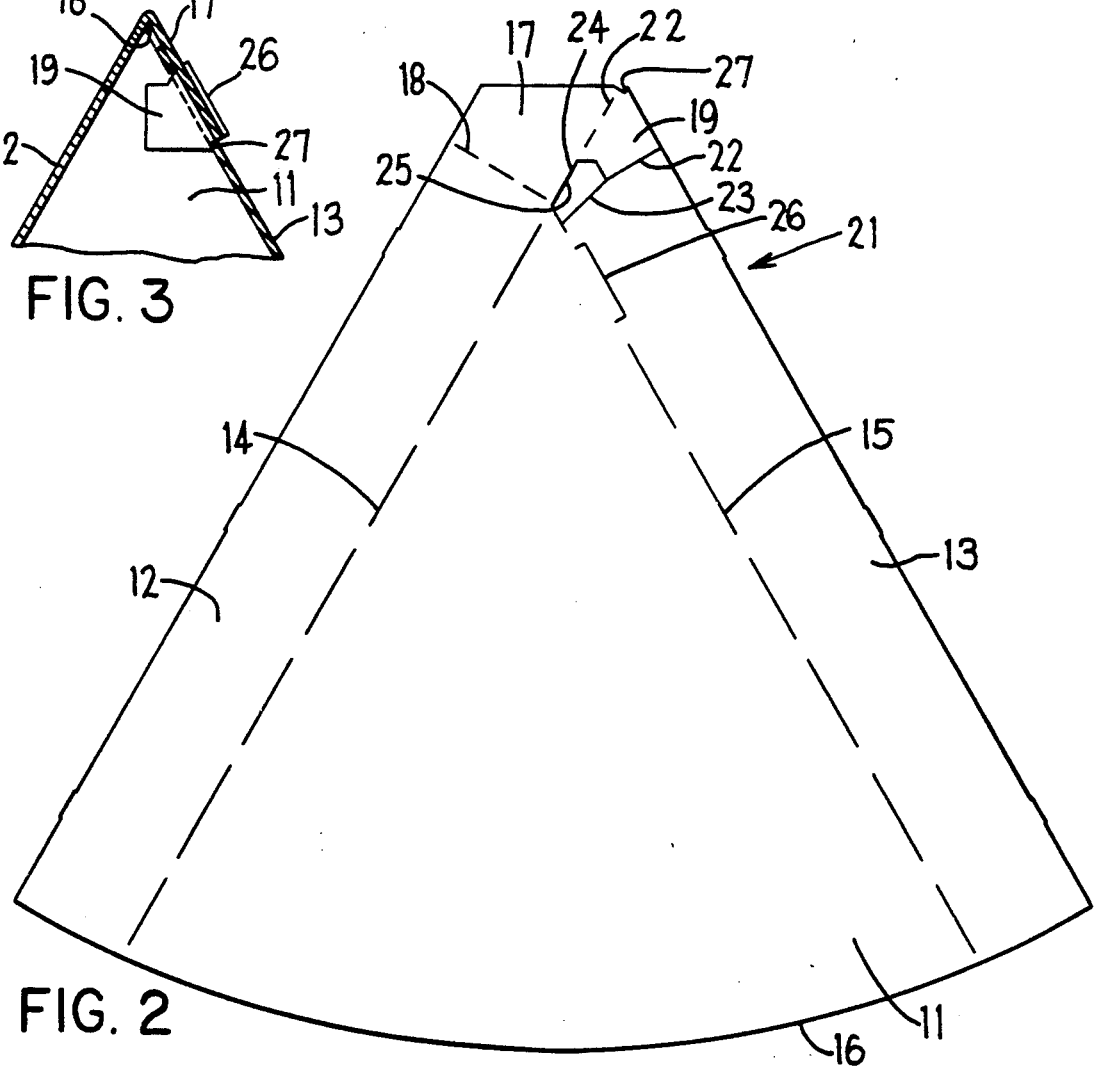
FIG. 2 is a plan view of a flat blank used for forming the tray of FIG. 1.

Referring to FIGS. 1 and 2, there is illustrated an open top carrier or tray 10 according to the present invention, which tray is designed particularly for supporting a single slice of hot pizza. The tray 10 includes a generally horizontally enlarged bottom wall 11 of generally triangular configuration having rather low side walls 12 and 13 projecting generally perpendicularly upwardly from the bottom wall 11 along the respective side edges 14 and 15 thereof. The side edges 14 and 15 are generally identical in length and substantially intersect at the apex of the bottom wall 11. These edges 14 and 15 are preferably defined as fold lines and typically define therebetween an included angle which is generally in the range of from 45° to 90°.

The tray also has an outer or base edge 16 which extends between the side edges 14 and 15 and which constitutes a free edge, whereby the interior of the tray is readily accessible either through the open top thereof or through the open base side thereof. This base edge 16, in the illustrated embodiment, is of circular contour generated about a center point which is spaced beyond (upwardly in FIG. 2) the apex of the bottom wall.

To maintain the tray 10 in the assembled position illustrated by FIG. 1 wherein the side walls 12 and 13 project generally perpendicularly upwardly from the bottom wall 11, the side wall 12 is provided with a latching tab 17 integrally joined thereto and projecting outwardly therefrom. This latching tab 17 is joined to a vertical end edge of the side wall 12 through a fold line 18 so that the tab 17 can be readily pivoted with respect to the plane of the side wall 12. The latching tab 17 has a latch or lock portion 19 projecting therefrom and adapted for insertion through a narrow slot 20 formed in the other side wall 13 directly along the edge 15, whereby the latch portion 19 can project through the side wall 13 in direct overlying relationship to the bottom wall 11.

The tray 10 is preferably formed as a flat generally triangular blank 21 as illustrated in FIG. 2. When in this flat condition, the latch tab 17 and its latching portion 19 are integrally joined to and disposed generally coplanar with the side wall 12. Further, the fold line or hinge 18 which joins the latch tab 17 to the side wall 12 projects generally perpendicularly from the fold line 14 substantially directly at the apex of the bottom wall 11. A further fold line or hinge 22 separates the latching portion 19 from the latch tab 17, and this fold line 22 effectively constitutes an extension of the fold line 13, whereby fold lines 22 and 18 extend generally in perpendicular relationship to one another.

The other side wall 13 terminates in a free end edge which is defined in part by a first cut line 22 which projects inwardly from the upper free edge of the wall 13 through about one-half the height thereof. This cut line 22 joins to a further cut line segment 23 which continues to project inwardly until intersecting the fold line 15. The cut line 22 defines one edge of the latch portion 19. The other cut line 23 cooperates with a further generally U-shaped cut line 24 so as to define a small opening 25 which extends totally through the board defining the blank 21. One leg of this cut line 24 extends generally along the fold line 15, whereas the bight or base of this cut line 24 extends generally along the fold line 14.

The blank 21 has a further generally U-shaped cut line 26 formed therein, which cut line 26 is formed in the side wall 13 in slightly spaced relationship from the apex of the bottom wall 11. The legs of cut line 26 project downwardly so as to intersect with the fold line 15. When the side wall 13 is folded into perpendicular relationship with the bottom wall 11, the cut 26 results in formation of the shallow slot 20 in the side wall 13, which slot 20 is disposed directly at and extends elongated along the fold line 15.

The latching portion 19, as illustrated by FIGS. 1 and 2, is of a generally arrow-shaped configuration terminating in a point at the free end thereof, and having a locking ledge or shoulder 27 at the rearward side to facilitate securement of the latching portion when engaged with the side wall 13.

When assembly of the tray 10 is desired, then the side walls 12 and 13 of the blank 21 are folded upwardly about their respective fold lines 14 and 15 so as to project generally perpendicularly upwardly relative to the bottom wall 11 This folding of the side wall 13 results in formation of the slot 20 due to the presence of the cut line 26. The latching tab 17 is then manually folded about the fold line 18 so that the tab effectively wraps around and overlies the outer surface of the side wall 13 in the vicinity of the bottom wall apex, and simultaneously therewith the latch tab 19 is folded upwardly about the fold line 22 into a generally horizontal position so as to be insertable into and through the slot 20 simultaneous with the folding of the latch tab 17 about the hinge 18. When the latching portion 19 is fully inserted through the slot 20, the latch shoulder 26 effectively engages against the inside of the side wall 13 to prevent release of the latch.

With the tray 10 thus assembled, an object and more specifically a slice of hot pizza can be readily supported and transported on the tray. Since the base or back side of the tray is fully opened along the edge 16, this greatly facilitates insertion of the pizza slice into the tray, and also facilitates removal of the pizza slice from the tray and reinsertion of the pizza slice into the tray as the consumer progressively eats the pizza slice. Since the tray is preferably constructed of corrugated paperboard, the tray possessed significant strength and rigidity, and at the same time is able to retain this strength and rigidly even though moisture and oils may be transferred thereto from the pizza. The tray also functions as an adequate insulator for both maintaining the warmth of the pizza and preventing the heat from being transmitted to the hand of the holder.

In addition, the tray 10 can be both economically manufactured and efficiently assembled, thereby providing a desirable carrier for pizza, particularly in shopping malls and the like.

To facilitate both economical manufacture, transport and storage of the blanks 21 which define the tray 10, the blanks 21 are preferably initially formed by means of a generally circular master blank 30 (FIG. 4) which defines a plurality (normally from four to eight) of individual blanks 21. This master blank 30 is of generally circular outer configuration as defined by the outer edge 16 which is generated about a radius projecting from the center point 33. The master blank 30 is provided with a plurality of heavy score lines which all extend through the center point 33 diametrically across the entirety of the blank. The plurality of heavy score lines 32 are uniformly angularly spaced apart, there being three such diametrical lines 32 in the illustrated embodiment so that the illustrated embodiment produces six individual identical sector-shaped blanks 21.

Each heavy score line 32 has a pair of lighter score or fold lines 34 disposed in parallel and uniformly spaced relationship on opposite sides thereof, which fold lines 34 define the side edge fold lines 13 and 15 of the individual blanks 21. The master blank 30 also has the cut lines 22 and 26 associated therewith, and the small openings 25 formed therein, which openings are disposed in a circular pattern about the center 33, with the openings 25 being generally uniformly angularly spaced apart so that each opening 25 is associated with a respective one of the individual blanks 21. The master blank 30 also has a generally polygonal opening 35 extending through the middle thereof and centered generally about the center point 33. This polygonal opening 35 has a number of sides which equals the number of individual blanks 21 and hence is twice the number of diametral score lines 32.

Figure 4:
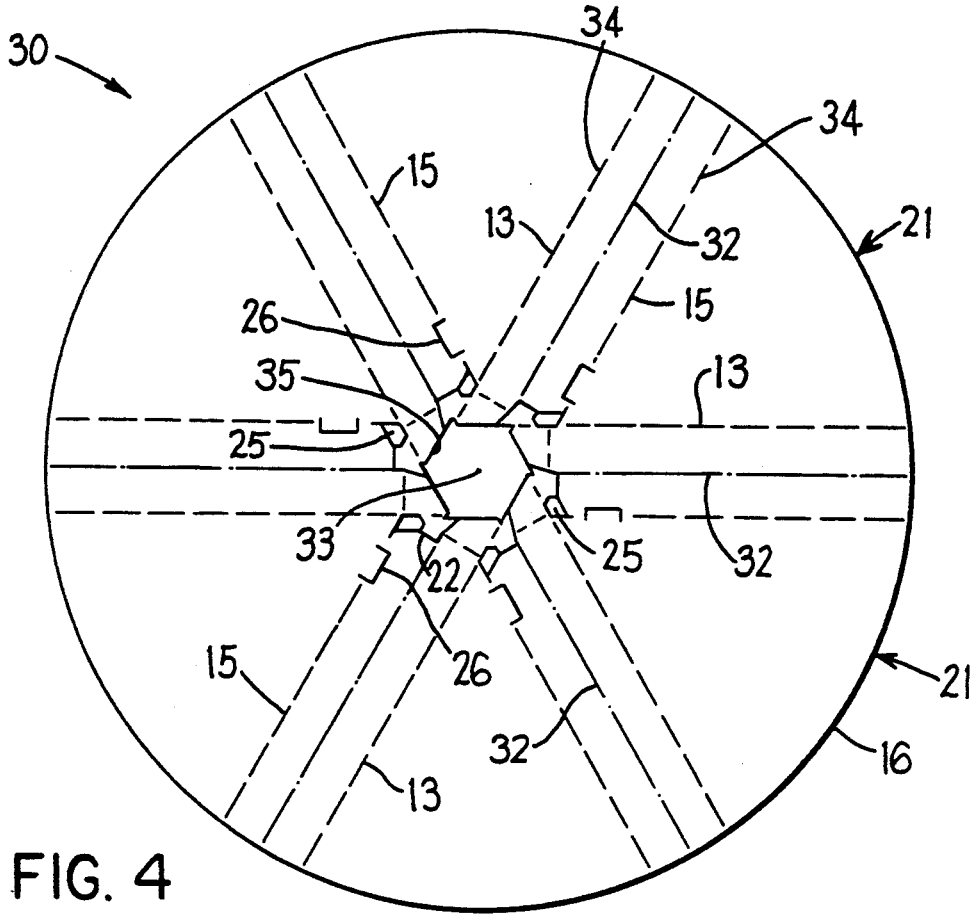
FIG. 4 is a plan view of a flat circular blank suitably scored so as to define a plurality of individually separable blanks corresponding to the tray of FIGS. 1 and 2.

With the master blank 30, one example of which is illustrated in FIG. 4, the individual blanks 21 can be readily separated from the master blank 30 by effecting separation along the heavy score lines 32, such normally being readily accomplished by a folding action along the score line. The thus separated individual blanks 21 can then be assembled and utilized in the manner described above.

Figure 5:
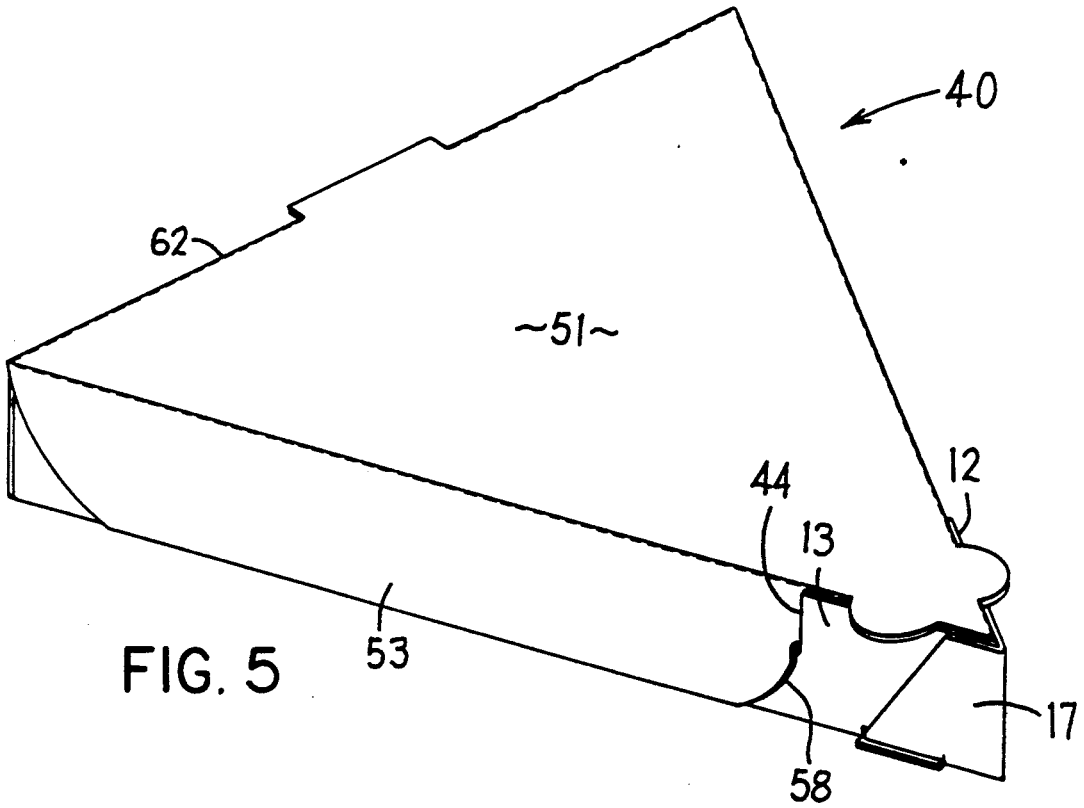
FIG. 5 is a perspective view of a second embodiment according to the present invention, and showing a closed tray.
Figure 6:
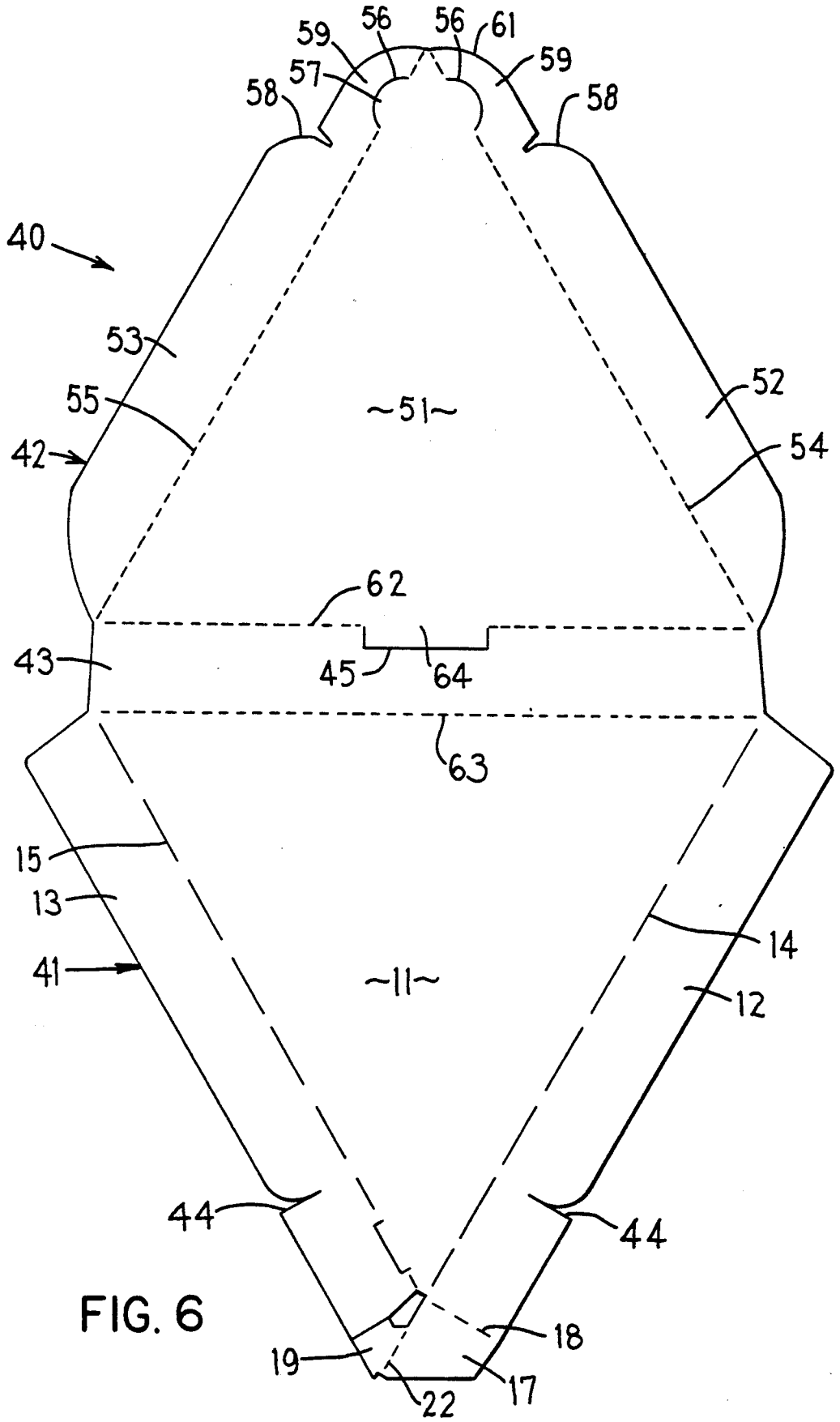
FIG. 6 is a plan view of a blank used for forming the tray of FIG. 5.

Referring now to FIGS. 5 and 6, there is illustrated a tray or carrier 40 particularly suitable for a single slice of pizza, which carrier 40 is closable to define therein a closed interior storage compartment for the pizza, thereby facilitating transport of the pizza while at the same time providing protection and heat retention.

This closable tray or carrier 40 is also preferably formed from a flat blank formed of corrugated paper board, such as the blank illustrated by FIG. 6.

The tray or carrier 40 includes lower and upper portions 41 and 42, respectively, which are joined together by a base portion 43 so as to permit closure of the carrier and creation of a closed compartment therein.

The lower portion 41 is of a construction extremely similar to the carrier 10 described above, and many of the same reference numerals are utilized to designate corresponding parts. More specifically, this lower portion has a generally triangular bottom wall 11 and a pair of side walls 12 and 13 which can be folded upwardly relative to the bottom wall about the fold lines 14 and 15, respectively. The side wall 12 again has the latching tab 17 joined thereto about the hinge or fold line 18 so as to permit the latch portion 19 to be latched in an assembled position in the vicinity of the apex of the bottom wall.

In addition, each of the side walls 12 and 13 has a notch or cut 44 which projects generally perpendicularly inwardly from the upper free edge thereof, which notch or cut 44 preferably projects inwardly toward the respective fold line 14 or 15 through a distance which is normally at least and preferably slightly greater than one-half the height of the respective side wall, although this notch or cut 44 stops short of the respective fold line 14 or 15. These notches or cuts 44 are disposed more closely adjacent the apex of the bottom wall 11, but are spaced a small distance from the side edge of the respective side wall.

As to the top portion 42, it includes a generally triangular top wall 51 which has a shape and size substantially corresponding to that of the bottom wall 11. The top wall 51 has identical opposite side edges 54 and 55 which intersect at the apex of the top wall, and these side edges 54 and 55 are defined by fold lines which integrally join the top wall to respective side flanges 52 and 53 which extend substantially the full length of the respective side edges 54 and 55. Each of the side flanges 52 and 53 has a generally U-shaped cut 56 formed therein in slightly inwardly spaced relationship from the apex, which cut has the legs thereof terminating substantially at the respective fold line so as to result in creation of a finger tab 57 which remains coplanar with and integrally joined to the top wall 51.

Each side flange 52 and 53 also has a cut or notch 58 formed so as to project inwardly from the free lower edge thereof through an extent at least one-half of and preferably slightly greater than one-half of the overall width of the side flange. This cut or notch 58 projects generally perpendicularly with respect to but terminates short of the respective fold line 54 and 55. These cuts 58 are spaced slightly from the apex of the top wall 51, and each side flange 52 and 53 includes a tab portion 59 which extends from the respective cut 58 to the apex of the top wall 51. This tab portion 59 is of reduced width relative to the width (i.e., height) of the remainder of the side flange, and in addition this tab portion terminates in a rounded edge 61 which joins to the apex of the top wall 51.

As is apparent from FIG. 6, the opposite sides of the top portion 42 are structurally identical and hence mirror images of one another.

The base edge of the top wall 51 is integrally joined to the base wall 43 by a fold line 62, and in a similar fashion the base wall 43 in turn joins to the base edge of the bottom wall 11 through a further fold line 63, the latter being generally parallel to the fold line 62. This base wall 43 has a width (i.e., height) as measured perpendicularly between the fold lines 62 and 63 which approximately corresponds to the width (i.e., height) of the side walls 12 and 13, and they in turn have a width which substantially corresponds to the width (i.e., height) of the side flanges 52 and 53.

The base wall 43 also has a U-shaped cut 45 formed therein, the legs of which terminate at the fold line 62. This cut 45 hence defines a tab 64 which remains coplanar with the top wall 51.

The blank for the closable tray or carrier 40 is, like the blank for the carrier 10, preferably cut from corrugated paperboard having a corrugated layer bonded between a pair of facing layers.

To assemble the carrier 40, the flat blank shown by FIG. 6 is appropriately manually folded in whatever sequence is most convenient to the operator. For example, the side walls 12 and 13 can be folded upwardly about the fold lines 14 and 15, respectively, and the latch 17 secured in the same manner described above relative to the carrier 10, thereby completing the construction of the bottom portion 41 of the carrier. In a similar fashion, the side flanges 52 and 53 of the top portion 42 can, with the carrier in the open position shown by FIG. 6, be folded upwardly about the respective fold lines 54 and 55. The back portion 43 can then be folded upwardly about the fold line 63 into generally perpendicular relationship to the bottom wall 11, and in similar fashion the top portion can be folded upwardly or inwardly about the fold line 62, thereby enabling the top and bottom portions to effectively telescopically fit one relative to the other to define a closed carrier or tray.

To effect actual closing of the tray 40, the cover or top portion 42 is pivotally swung so as to generally overlie the bottom portion 41 with the side flanges or flaps 52 and 53 of the cover being disposed so as to externally overlie the respective side walls 12 and 13 of the bottom portion 41. The cover and bottom portions are positioned in only slightly angled relationship to one another (that is, the top and bottom walls 51 and 11 will be at an angle of about 10° to 15° relative to one another) so that the top side flanges 52 and 53 partially externally overlap the respective bottom side walls 12 and 13. When in this position, the operator can then utilize one hand so as to manually grip (such as between a thumb and forefinger) the opposed flap portions 59 and slightly deflect them inwardly toward one another, following which the cover portion is then swung downwardly into a completely closed position so as to cause the flap portions 59 to slide inside and interiorly overlap the adjacent end portions of the side walls 12 and 13. This is permitted inasmuch as the notches or cuts 44 and 58 align and effectively interfit with one another, as illustrated by FIG. 5, to enable the flat portions 59 to engage inside the lower side walls 12 and 13, whereas the remainder of the top side flanges 52 and 53 externally overlie the bottom side walls 12 and 13. The flaps 59 have a natural tendency to want to return back to a condition of being flat or aligned with the cover wall 51, and hence the flaps effectively frictionally grip the inner sides of the side walls 12 and 13 and assist in retaining the cover portion in the closed position. This engaged relationship between the side walls and side flanges also holds the carrier in its assembled state and provides strength and rigidity.

When in the closed position, the cut 45 results in formation of an elongate slot or opening formed through the base wall 43, which opening communicates directly with the interior of the closed carrier to permit release of moisture from the carrier interior. Provision of this opening is optional depending upon the food product with which use of the carrier is intended. Also, the tabs 57 project outwardly over the lower side walls 12 and 13 to facilitate gripping of the cover when opening of the carrier is desired.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A tray for supporting a slice of pizza, comprising:

a generally triangularly shaped bottom wall having first and second side edges which intersect generally at an apex of the bottom wall, said bottom wall having a base edge which joins the other ends of said first and second side edges;

first and second side walls integrally joined to said bottom wall through hinge portions defined by first and second fold lines which extend along and define the respective first and second side edges, said side walls projecting generally upwardly in substantially perpendicular relationship relative to said bottom wall, and said first and second side walls respectively having first and second generally vertically extending end edges which are positioned closely adjacent one another in the vicinity of said apex;

a latch tab integrally joined to said first side wall through a hinge portion defined by a third fold line which extends along said first end edge to permit said latch tab to be folded in transverse relationship relative to said first side wall, said latch tab being disposed so as to directly overlie said second side wall in the vicinity of said apex and having a latching projection engageable with said second side wall for maintaining said first and second side walls in generally fixed relationship with respect to one another and with respect to said bottom wall;

said latch tab including a base portion joined to said first side wall through the third fold line, the latching projection being defined at a free end of said latching tab and being joined to said base portion through a fourth fold line which extends generally perpendicularly with respect to said third fold line, and said second side wall having a narrow elongate slot formed therethrough in generally parallel relationship with and in close proximity to said second fold line for permitting insertion of said latching projection therethrough so that the latching projection directly overlies said bottom wall;

said tray having a wholly open top and also being wholly open along the base edge thereof to permit a pizza slice to be easily positioned into or removed from said tray; and said tray being formed in its entirety from a one-piece unitary block of thin sheetlike material.

2. A master blank defining a plurality of sector-shaped blanks for sector-shaped trays, comprising: a thin and flat sheet of corrugated paperboard having a peripheral edge defined substantially as a circle generated about a center point of said sheet, a plurality of score lines extending diametrically across said sheet, said score lines being substantially uniformly angularly spaced apart so as to divide said sheet into a plurality of arcuate sectors of uniform size, said score lines permitting adjacent sectors to be readily separated from one another, a pair of fold lines formed in said sheet in close association with each of said score lines, said pair of fold lines being disposed closely adjacent but uniformly spaced on opposite sides of the respective score line and extending generally parallel therewith, said fold lines having opposite ends thereof terminating at the peripheral edge of the sheet, a polygonal opening extending through said sheet and disposed so that the center point of said sheet is located centrally of said polygonal opening, said polygonal opening having a plurality of straight sides which is equal in number to the number of arcuate sectors, a small opening formed through each said sector in closely adjacent relationship to but spaced slightly radially outwardly from a respectively adjacent straight side of said polygonal opening, said small opening being disposed closely adjacent an apex defined by the intersection of the two fold lines defined on the respective arcuate sector so that said small opening has one side which extends along one of said two fold lines and a second side which extends along the other of said two fold lines, a short cut line formed in each said sector and having one end thereof communicating with said small opening and the other end projecting transversely outwardly away from said one fold line for termination at the respectively adjacent score line, and a short fold line formed in each said sector and at one end thereof communicating with said other fold line in the region of said small opening and extending transversely outwardly away from said other fold line for termination at the score line which defines the other side of said sector.

3. A blank according to claim 2, wherein each of the sectors has a small slot-forming cut line formed therein adjacent said one fold line and in close proximity to the respective apex, and wherein the short fold line communicates at the one end thereof with said other fold line substantially at the respective apex.

4. A closeable carrier or tray arrangement of generally triangular configuration for defining an interior generally triangular shaped compartment for supporting and transporting an object such as a slice of pizza, comprising:

a bottom portion of generally triangular-shaped configuration;

a cover portion of generally triangular shaped configuration;

a base portion joined between said bottom and cover portions, said base portion being hingedly joined along a first hinge line to said bottom portion and being hingedly joined along a second hinge line to said cover portion, said first and second hinge lines being generally parallel with one another and vertically spaced apart by a distance which substantially corresponds to the vertical height of the carrier when in a closed position;

said cover portion, base portion and bottom portion being defined by an integral one-piece unitary blank constructed of a thin and relatively stiff sheetlike paperboard material;

said bottom portion including a bottom wall which is shaped generally as a triangle having equal-length first and second side edges which intersect at an apex and which at opposite ends are joined by a base edge;

said bottom portion including first and second side walls which are integrally joined to said bottom wall by first and second fold lines which extend along and define the respective first and second side edges so that said first and second side walls project generally perpendicularly upwardly relative to said bottom wall;

said bottom portion including a latching means which cooperates between said first and second side walls in the vicinity of said apex for holding said side walls in an upright relationship relative to said bottom wall, said latch means including a latch tab which is integrally joined to said first side wall through a third fold line which extends generally perpendicularly with respect to said first fold line and substantially intersects said apex, a cantilevered latching projection integrally joined to and projecting outwardly from said latching tab and being integrally joined thereto about a fourth fold line which extends substantially transversely relative to said third fold line, and an elongate slot formed in said second side wall in generally the elongate direction thereof in close proximity to a free end edge of said second side wall as disposed in close proximity to said apex, said latch tab being folded about said third fold line so that the latch tab exteriorly overlaps said second side wall in the vicinity of said apex and said latching projection is folded about said fourth fold line for projection through said slot;

said base portion comprising a base wall which along a lower edge thereof is integrally joined to said bottom wall by a fifth fold line which defines said first hinge line and extends along the base edge of said bottom wall;

said cover portion including a top wall of generally triangular configuration having a shape and size which substantially corresponds to that of said bottom wall, said cover portion having a base edge which is integrally joined to said base wall along a sixth fold line which defines said second hinge line;

said cover portion having first and second side edges which are of substantially equal length and project away from the respective base edge for termination at an apex, said cover portion having first and second side flanges which are integrally joined to said top wall through respective seventh and eighth fold lines which respectively define and extend along said first and second side edges so that said first and second side flanges can project downwardly from said top wall; and each of the first and second side flanges of said cover having a notch or cut projecting inwardly from a free edge thereof at a distance spaced a predetermined extent from the respective apex, and each of the first and second side walls of the bottom portion having a notch or cut projecting inwardly from a respective free edge thereof at a distance spaced from the respective apex which substantially corresponds to the spacing of the cuts in the cover from the respective apex, whereby closure of the cover portion unto the bottom portion causes the cuts in the cover side flanges to generally align with the cuts in the bottom side walls so that the cuts telescopically engage to permit portions of the cover side flanges to nest inside the bottom portion while the remaining portions of the cover side flanges fit outside the bottom portion.

5. A master blank defining a plurality of sector-shaped blanks for sector-shaped trays, comprising:

a thin and flat sheet of corrugated paperboard having a peripheral edge defined approximately as a circle generated about a central point of said sheet, a plurality of score lines extending diametrically across said sheet, said score lines being substantially uniformly angularly spaced apart so as to define said sheet into a plurality of arcuate sectors of uniform size, said score lines permitting adjacent sectors to be readily separated from one another, a pair of fold lines formed in said sheet in close association with each of said score lines, said pair of fold lines being disposed closely adjacent but uniformly spaced on opposite sides of the respective scorer line and extending generally parallel therewith, said fold lines having opposite ends thereof terminating at the peripheral edge of the sheet, a central opening extending through said sheet and disposed so that the center point of said sheet is located centrally of said central opening, said central opening being sized so that an apex defined by the intersection of the two fold lines defined on a respective said arcuate sector is disposed closely adjacent but spaced radially outwardly by a small distance from said central opening, a short fold line formed in each said sector, said short fold line at one end thereof communicating with one of said fold lines substantially in the region of the respective apex and extending transversely outwardly away from said one fold line for termination at the adjacent score line, and a short cut line formed in each said sector in the vicinity of the respective apex, said short cut line communicating at one end thereof with the other fold line and extending outwardly away from said other fold line for termination at the other score line.

6. A master blank according to claim 5, including a small opening formed through each said sector in closely adjacent relationship to the respective apex, said small opening being spaced radially outwardly from said central opening, and said short cut line communicating with the small opening of the respective sector.

* * * * *

UNITED STATES PATENT AND TRADEMARK OFFICE

CERTIFICATE OF CORRECTION

PATENT NO. : 5 098 013

DATED : March 24, 1992

INVENTOR(S) : Stephen L. France et al

It is certified that error appears in the above-identified patent and that said Letters Patent is hereby corrected as shown below:

Column 8, line 21; change "block" to ---blank---.

Signed and Sealed this

Twenty-first Day of September, 1993

Bruce Lehman

*Attest:*

BRUCE LEHMAN

*Attesting Officer*

*Commissioner of Patents and Trademarks*